US010029509B2

(12) United States Patent
Chard

(10) Patent No.: US 10,029,509 B2
(45) Date of Patent: Jul. 24, 2018

(54) MARKING DEVICE AND METHOD

(71) Applicant: Martin Chard, London (GB)

(72) Inventor: Martin Chard, London (GB)

(73) Assignee: Marxman Limited, London (GB)

( * ) Notice: Subject to any disclaimer, the term of this patent is extended or adjusted under 35 U.S.C. 154(b) by 0 days.

(21) Appl. No.: 15/209,607

(22) Filed: Jul. 13, 2016

(65) Prior Publication Data

US 2016/0318333 A1 Nov. 3, 2016

Related U.S. Application Data

(60) Continuation of application No. 14/510,206, filed on Oct. 9, 2014, which is a division of application No.
(Continued)

(30) Foreign Application Priority Data

Nov. 22, 2010 (GB) ..... 1019728.3
Jan. 13, 2011 (GB) ..... 1100545.1

(51) Int. Cl.
*B43L 13/00* (2006.01)
*B43K 8/00* (2006.01)
(Continued)

(52) U.S. Cl.
CPC ..... *B43K 8/006* (2013.01); *B05D 1/12* (2013.01); *B25H 7/045* (2013.01); *B43K 5/005* (2013.01);
(Continued)

(58) Field of Classification Search
CPC ..... B43K 23/02; B43K 3/10; B43K 3/12
See application file for complete search history.

(56) References Cited

U.S. PATENT DOCUMENTS 2,582,262 A * 1/1952 Loven ..... B65D 83/46 222/394
6,926,696 B2 * 8/2005 Mohammed ..... A61M 5/3257 604/195
(Continued)

OTHER PUBLICATIONS

DavidDarling (http://www.daviddarling.info/encyclopedia/A/aerosol.html, retrieved Jan. 25, 2016, cached Feb. 1, 2001).*
(Continued)

*Primary Examiner* — Francisco W Tschen
(74) *Attorney, Agent, or Firm* — Phillips Lytle LLP; David L. Principe

(57) ABSTRACT

A device for marking a surface, the device comprising: a body configured to store a marking substance; a guide arrangement having a first end and a second end, at least a portion of an outer surface of the guide arrangement tapering from the first end to the second end which is narrower than the first end, wherein an output path is provided through the second end at substantially the center of the guide arrangement; an activation arrangement; and a delivery arrangement which is configured, in response to triggering of the activation arrangement, to deliver a quantity of the marking substance from the body, along the output path and out of the second end, wherein, in use, a user inserts at least the second end of the guide arrangement into an aperture in an element positioned adjacent a surface until the outer surface of the guide arrangement contacts the aperture, and the user triggers the activation arrangement to deliver a quantity of the marking substance through the second end and onto the surface to mark the surface at a position which is substantially aligned with the center of the aperture.

17 Claims, 7 Drawing Sheets

Related U.S. Application Data

13/697,456, filed as application No. PCT/GB2011/052287 on Nov. 22, 2011.

(51) Int. Cl.

| | |
|---|---|
| ***B25H 7/04*** | (2006.01) |
| ***B43K 5/00*** | (2006.01) |
| ***B43K 5/03*** | (2006.01) |
| ***B43K 5/06*** | (2006.01) |
| ***B43K 5/14*** | (2006.01) |
| ***B43K 5/18*** | (2006.01) |
| ***B43K 7/02*** | (2006.01) |
| ***B43K 8/03*** | (2006.01) |
| ***B43K 8/04*** | (2006.01) |
| ***B43K 19/00*** | (2006.01) |
| ***B43K 21/02*** | (2006.01) |
| ***B43K 23/016*** | (2006.01) |
| ***B05D 1/12*** | (2006.01) |

(52) U.S. Cl.

CPC ..... *B43K 5/03* (2013.01); *B43K 5/06* (2013.01); *B43K 5/14* (2013.01); *B43K 5/18* (2013.01); *B43K 5/1818* (2013.01); *B43K 5/1827* (2013.01); *B43K 7/02* (2013.01); *B43K 8/00* (2013.01); *B43K 8/03* (2013.01); *B43K 8/04* (2013.01); *B43K 19/003* (2013.01); *B43K 21/02* (2013.01); *B43K 23/016* (2013.01); *B43L 13/00* (2013.01)

(56) References Cited

U.S. PATENT DOCUMENTS

| | | | | |
|---|---|---|---|---|
| 2001/0056263 | A1* | 12/2001 | Alchas | A61M 5/32 604/193 |
| 2002/0100472 | A1* | 8/2002 | Casper | A61M 15/0095 128/200.23 |
| 2005/0172960 | A1* | 8/2005 | Gutsell | G01F 11/32 128/202.13 |
| 2006/0110328 | A1* | 5/2006 | Cagle | A61K 31/00 424/45 |
| 2009/0324815 | A1* | 12/2009 | Nielsen | B65D 83/75 427/137 |
| 2010/0179486 | A1* | 7/2010 | Lin Lee | A61M 5/5066 604/195 |

OTHER PUBLICATIONS

A Guide to Decorating Wooden Furniture, https://home.howstuffworks.com/home-improvement/home-diy/furniture-restoration/guide-to-decorating-wooden-furniture-ga4.htm, Retrieved Dec. 14, 2014, Published Oct. 24, 2006 (Year: 2006).*

* cited by examiner

MARKING DEVICE AND METHOD

CROSS-REFERENCE TO RELATED APPLICATION

The present application is a continuation of U.S. patent application Ser. No. 14/510,206 filed Oct. 9, 2014, which is a divisional application of U.S. patent application Ser. No. 13/697,456 filed Nov. 12, 2012, which is a 371 of International Application No. PCT/GB2011/052287 filed Nov. 22, 2011, which claims priority of a) GB 1100545.1 filed Jan. 13, 2011, and b) GB 1019728.3 filed Nov. 22, 2010.

TECHNICAL FIELD

The present invention relates to a marking method and device, and more particularly relates to a method and device for marking a surface which is positioned adjacent an element incorporating an aperture.

BACKGROUND ART

A cabinet, such as a kitchen or bathroom cabinet, usually incorporates mounting holes in a rear surface or in brackets attached to the cabinet to enable the cabinet to be mounted to a wall. To mount the cabinet to a wall a person typically holds the cabinet against the wall with one hand by pressing the cabinet against the wall. A spirit level is placed on top of the cabinet or on a shelf in the cabinet to help the person hold the cabinet level. Whilst holding the cabinet with one hand, the person takes a pencil with their other hand and attempts to mark the wall adjacent the rear surface of the cabinet, aligned with the center of each of the mounting holes, by inserting the tip of the pencil through each of the mounting holes. The person then moves the cabinet away from the wall and drills holes in the wall at each of the marked points. The drilled holes should line up with the mounting holes, allowing the cabinet to be secured to the wall.

The rear surface of a cabinet is often spaced back from the rear edge of the side panels, to allow for mounting to an uneven surface, or even to allow services (e.g. pipes) to be installed in the void formed between the rear surface and the wall. As a result, the mounting hole may be spaced some distance from the wall. The diameter of the mounting hole (which can be as small as 4 mm) is generally smaller than the diameter of a typical marking device (e.g. pen or pencil) at the person's disposal. Accordingly, especially if the rear surface of the cabinet is spaced sufficiently from the wall, the marking element of the device may not be able to protrude all the way through to the wall, thereby preventing a mark being made.

Although especially the case with cabinets—where the surface with mounting holes is spaced from the wall to be marked—the same problem may be encountered with other items to be secured to a surface, for example, shelf brackets, electrical units, window frames, structural members etc. Even when the item is able to be placed in contact with the wall, the depth of the mounting hole may be so large, and/or the diameter of the mounting hole may be so small, that a conventional marking device is not sufficient.

Attempts to alleviate this problem are sometimes made when using a pencil, by sharpening the tip such that it tapers with a shallow angle, so that the exposed lead extends further beyond the main body of the pencil. The pencil may then protrude further through the mounting hole, to reach the surface. An alternative is to use a propelling or clutch pencil, by extending the lead far beyond the body of the pencil.

However, pencils are not designed for such uses and so the lead tends to snap easily. Moreover, a pencil is not an appropriate marker for some surfaces (e.g. tiles or brick).

Still further, it is difficult for a person to make a mark on the wall accurately aligned with the center of each of the mounting holes whilst the person is holding the cabinet with one hand and trying to make the marks with the pencil in their other hand. The cabinet may slip during the marking process. The person must then either try to re-align the holes with the marks already made—which relies on the marks being visible through the holes—or have to start again and reposition the cabinet in a new location, marking the wall aligned with each hole once more. This extra step to correct the misalignment or to reposition is time consuming and problematic.

SUMMARY OF THE INVENTION

The present invention seeks to provide an improved method of marking a surface and a device for marking a surface.

According to one aspect of the present invention, there is provided a method of marking a surface comprising: providing a marking device which incorporates: a body configured to store a marking substance, a guide arrangement having a first end and a second end, at least a portion of an outer surface of the guide arrangement tapering from the first end to the second end which is narrower than the first end, wherein an output path is provided through the second end at substantially the center of the guide arrangement, an activation arrangement, and a delivery arrangement which is configured, in response to triggering of the activation arrangement, to deliver a quantity of the marking substance from the body, along the output path and out of the second end, inserting at least the second end of the guide arrangement into an aperture in an element positioned adjacent a surface until a portion of the outer surface of the guide arrangement contacts the aperture, and activating the activation arrangement so that the delivery arrangement delivers a quantity of the marking substance through the second end and onto the surface to mark the surface at a position which is substantially aligned with the center of the aperture.

Preferably, the body is configured to store the marking substance in a chamber. Conveniently, the body incorporates an inlet through which a quantity of the marking substance can be introduced to at least partly fill the chamber. Alternatively, the body containing the marking substance may be removeable from the guide arrangement.

In one embodiment the body incorporates a recess to receive a cartridge containing a quantity of the marking substance.

In another embodiment the marking substance is ink.

In a further embodiment the ink is a dry ink.

In a still further embodiment the marking substance is a powder.

Preferably the powder is chalk powder.

Conveniently the delivery arrangement comprises a valve which is configured to be opened in response to triggering of the activation arrangement.

In one embodiment the valve is configured to open continuously whilst the activation arrangement is triggered.

In another embodiment the valve is a shuttle valve which is configured to deliver a predetermined quantity of the marking substance along the output path in response to triggering of the activation arrangement.

Preferably the device incorporates a source of compressed gas, the valve of the delivery arrangement being configured to release a quantity of the compressed gas to drive a quantity of the marking substance along the output path.

Conveniently the source of compressed gas is removable from the device.

Advantageously the source of compressed gas is refillable.

Preferably the portion of the outer surface of the guide arrangement is frusto-conical in shape.

Conveniently the outer surface of the frusto-conical outer surface is inclined at an angle of substantially 45° to the longitudinal axis of the guide arrangement.

In one embodiment the portion of the outer surface of the guide arrangement is curved.

In another embodiment the guide arrangement comprises a plurality of elongate guide elements and the portion of the outer surface is defined by a portion of the outer surfaces of the elongate guide elements.

In another embodiment the angle of each of the guide elements relative to the longitudinal axis of the guide arrangement is adjustable.

In a further embodiment the guide arrangement covers the activation arrangement and is moveable relative to the body.

Preferably movement of the activation arrangement from a first position to a second position triggers the activation arrangement.

Conveniently the step of triggering the activating arrangement comprises pushing the cover against the aperture so that the cover moves relative to the body.

In another embodiment the activation arrangement comprises a manually operable switch.

Preferably, the delivery arrangement is moveably mounted with respect to the body and configured such that, in response to triggering of the activation arrangement, the delivery arrangement extends from the body, with respect to the guide arrangement, to deliver a quantity of the marking substance from the body.

Conveniently, the delivery arrangement is biased away from the body.

According to a further aspect of the present invention, there is provided a device for marking a surface, the device comprising: a body configured to store a marking substance, a guide arrangement having a first end and a second end, at least a portion of an outer surface of the guide arrangement tapering from the first end to the second end which is narrower than the first end, wherein an output path is provided through the second end at substantially the center of the guide arrangement, an activation arrangement, and a delivery arrangement which is configured, in response to triggering of the activation arrangement, to deliver a quantity of the marking substance from the body, along the output path and out of the second end, wherein, in use, a user inserts at least the second end of the guide arrangement into an aperture in an element positioned adjacent a surface until the outer surface of the guide arrangement contacts the aperture, and the user triggers the activation arrangement to deliver a quantity of the marking substance through the second end and onto the surface to mark the surface at a position which is substantially aligned with the center of the aperture.

BRIEF DESCRIPTION OF THE DRAWINGS

In order that the invention may be more readily understood, and so that further features thereof may be appreciated, embodiments of the invention will now be described, by way of example, with reference to the accompanying drawings in which.

DESCRIPTION OF THE PREFERRED EMBODIMENTS

Figure 1:
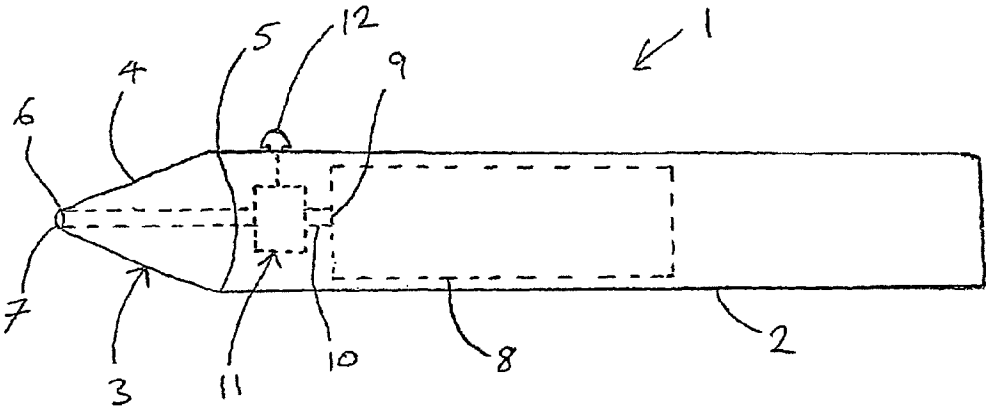
FIG. 1 is a diagrammatic side view of a device in accordance with a preferred embodiment of the invention.
Figure 2:
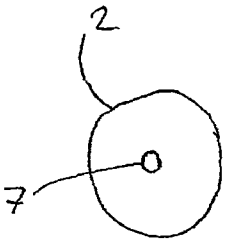
FIG. 2 is a diagrammatic end view of the device shown in FIG. 1.

Referring initially to FIG. 1 of the accompanying drawings, a device 1 in accordance with a preferred embodiment of the invention incorporates an elongate body 2. The body 2 is substantially cylindrical in cross section, as shown in FIG. 2. An elongate guide arrangement 3 is provided at one end of the body 2. In this preferred embodiment, the guide arrangement 3 is formed integrally with the body 2, but in other embodiments, the guide arrangement 3 is a separate component which is attached to the body 2.

The guide arrangement 3 incorporates an outer surface 4. A portion of the outer surface 4 tapers from a first end 5 to a second end 6 which is narrower than the first end 5. In this preferred embodiment, the portion of the outer surface 4 is substantially frusto-conical in shape. The outer surface 4 is preferably angled at approximately 45° to the longitudinal axis of the guide arrangement 3. The outer surface 4 is symmetrical about the longitudinal axis of the guide arrangement 3. The second end 6 is provided with an opening 7, the purpose of which will be described below.

The body 2 is configured to store a marking substance (not shown). In this preferred embodiment, the body 2 incorporates a chamber 8 which is configured to store the marking substance. The chamber 8 may be filled with a quantity of the marking substance which is preferably liquid ink, dry ink, or powder. The powder may be chalk powder. The marking substance is preferably stored with a propellant that is held under pressure within the chamber 8. The marking substance might, for instance, be held as an aerosol in the chamber 8. In this preferred embodiment, the chamber 8 is sealed, but in other embodiments, the chamber 8 incorporates an inlet through which a quantity of marking substance and/or a quantity of pressurised gas propellant can be introduced into the chamber 8 to fill or re-fill the chamber 8.

The chamber 8 incorporates an outlet 9 which is connected to an output path 10. The output path 10 extends from the chamber 8, through the guide arrangement 3 to the opening 7 at the second end 6 of the guide arrangement 3.

The device 1 incorporates a delivery arrangement 11 which, in this embodiment, is a valve 11. The valve 11 is positioned along the output path 10. When the valve 11 is closed, the valve 11 blocks the output path 10 and prevents the marking substance from travelling from the chamber 8 along the output path 10 and through the guide arrangement 3.

The valve 11 is controlled by an activation arrangement which, in this embodiment, is a manually operable push switch 12. In use, a user triggers the activation arrangement by pushing the switch 12. In response to triggering of the activation arrangement, the valve 11 of the delivery arrangement opens to allow a quantity of the marking substance to travel from the chamber 8, along the output path 10 and out through the opening 7 in the second end 6 of the guide arrangement 3. When the user releases the push switch 12, the activation arrangement is no longer triggered and so the valve 11 of the delivery arrangement closes to block the flow of marking substance along the output path 10.

In other embodiments, the valve 11 is a shuttle valve which is configured to allow only a predetermined quantity (a "burst") of marking substance to flow along the output path 10 when the activation arrangement is triggered.

Figure 3:
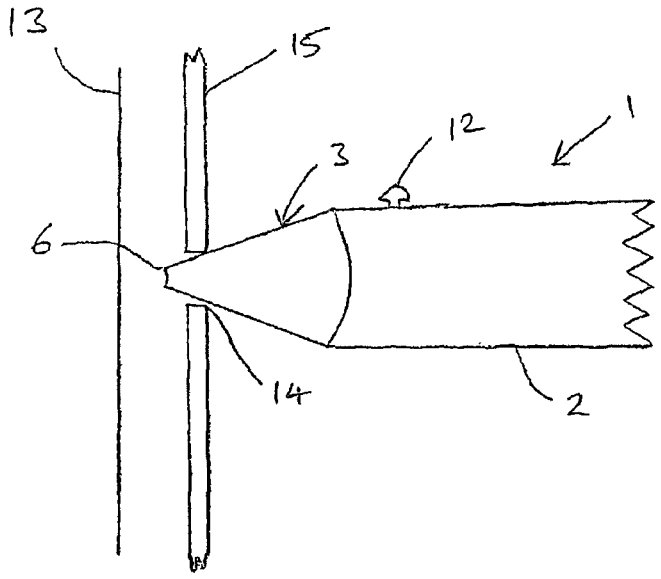
FIG. 3 is a diagrammatic side view of part of the device shown in FIG. 1 inserted into an aperture in an element positioned adjacent a surface, with the device in an unactivated condition.

Referring now to FIG. 3 of the accompanying drawings, a user can use the device 1 to mark a surface 13 at a position which is substantially adjacent to, and aligned with, the centre of an aperture 14 in an element 15. The element 15 might, for instance, be the rear surface of a cabinet and the mounting aperture 14 might for instance be a mounting aperture to mount the cabinet to the surface 13.

The user inserts at least the second end 6 of the guide arrangement 3 into the aperture 14 until a portion of the outer surface 4 contacts the aperture 14, as shown in FIG. 3. The symmetry of the guide arrangement 3 about its longitudinal axis ensures that when the outer surface 4 contacts the aperture, the opening 7 at the second end 6 of the guide arrangement 3 is positioned adjacent substantially the centre of the aperture 14. The user can press the device 1 towards the element 15 so that the outer surface 4 rests against the aperture 14 and allows the user to hold the device 1 stably in this position. The alignment of the device by the outer surface contacting the aperture 14 automatically centers the guide arrangement 3 in the aperture 14.

Figure 4:
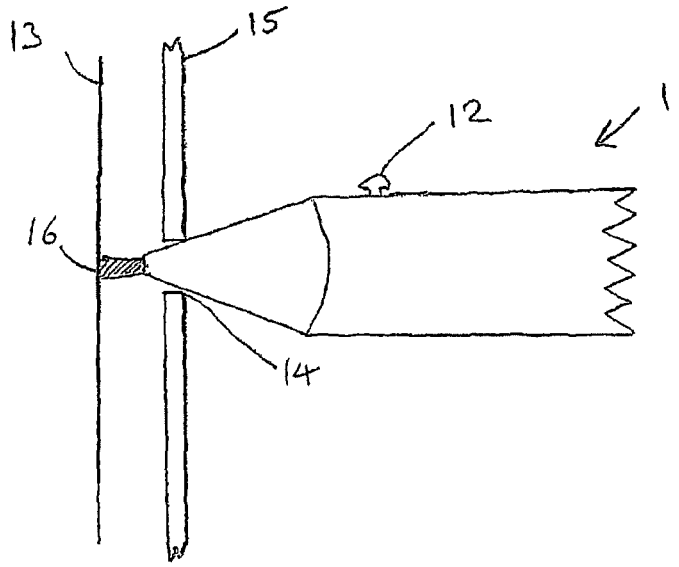
FIG. 4 is a view corresponding to FIG. 3, with the device in an activated condition.

When the second end 6 is inserted into the aperture 14, the user presses the switch 12 to trigger the activation arrangement. The valve 11 opens in response to the switch 12 being pressed to allow a quantity of the marking substance to travel from the chamber 8, along the output path 10 and out from the second end 6 of the guide arrangement 3, as shown in FIG. 4. The marking substance marks the surface 13 at a point 16 which is substantially adjacent the center of the aperture 14. A hole can then be drilled at the marked point to enable a fixture passing through the aperture 14 in the element 15 to align with the drill hole so that the element 15 can be mounted to the surface 13.

The method allows a surface to be marked quickly and easily by burst-marking, since the guide arrangement 3 automatically aligns the device 1 with the center of the aperture 14.

Figure 5:
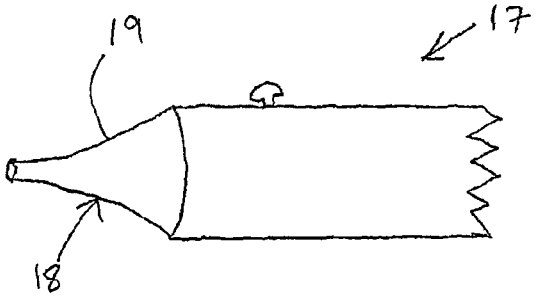
FIG. 5 is a diagrammatic side view of part of a device in accordance with a further embodiment of the invention.

Referring now to FIG. 5 of the accompanying drawings, a device 17 in accordance with a further embodiment of the invention is similar to the device 1 described above except that the device 17 of this further embodiment incorporates a guide arrangement 18 which has an outer surface 19 which is curved. In the embodiment shown, the outer surface 19 is concave. In another embodiment, the surface might be convex.

The outer surface 19 is still symmetrical around the longitudinal axis of the guide arrangement 18 and so the outer surface 19 still enables the guide arrangement 18 to automatically align the end of the guide arrangement 18 with the centre of the aperture 14.

Figure 6:
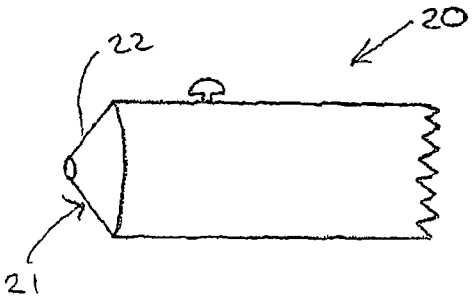
FIG. 6 is a diagrammatic side view of part of a device in accordance with a yet further embodiment of the invention.

Referring now to FIG. 6 of the accompanying drawings, a device 20 in accordance with a yet further embodiment of the invention is similar to the device 1 described above, but the guide arrangement 21 of this yet further embodiment incorporates an outer surface 22 which is at a steeper angle to the longitudinal axis of the guide arrangement 21. The steeper angle is, for instance, greater than 45° to the longitudinal axis of the guide arrangement 21. The angle is preferably between 45° and 80° to the longitudinal axis of the guide arrangement 21. The steeper angle enables the guide arrangement 21 to align the end with the center of an aperture in a thin element, such as a metal shelf bracket, which might, for instance, be less than 3 mm thick.

Figure 7:
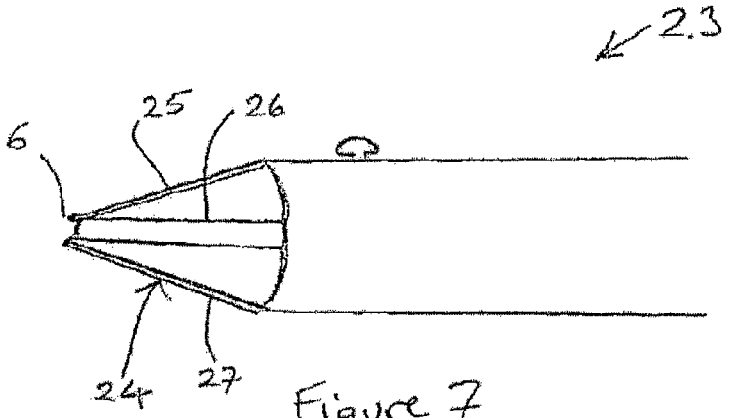
FIG. 7 is a diagrammatic side view of part of a device in accordance with a still further embodiment of the invention.
Figure 8:
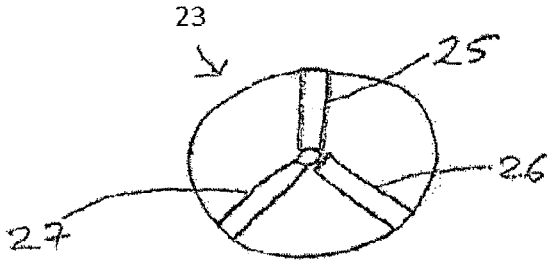
FIG. 8 is a diagrammatic end view of the device shown in FIG. 7.

Referring now to FIGS. 7 and 8 of the accompanying drawings, a device 23 in accordance with a still further embodiment of the invention is similar to the device 1 described above except that the device 23 of this embodiment incorporates a modified guide arrangement 24. The guide arrangement 24 incorporates three elongate guide elements 25-27. The elongate guide elements 25-27 are attached at one end to the body of the device 23. The elongate guide elements 25-27 converge towards one another at the second end 6 of the guide arrangement 24. The outer surfaces of the elongate guide elements 25-27 together define an outer surface envelope which can contact the aperture 14 in the element 15 when the device 23 is in use.

In other embodiments, the elongate guide elements 25-27 are moveable so that the angle of the elongate guide elements 25-27 can be adjusted relative to the longitudinal axis of the device 23. The guide arrangement 24 can thus be adjusted to match the size of the aperture or the thickness of the element incorporating the aperture.

An additional benefit of the embodiment shown in FIGS. 7 and 8 is that, where a pressurized gas source is used to deliver the marking substance, the space between the guide elements acts as a pressure relief path. A continuous conical surface might otherwise seal against the aperture. Where the other end of aperture is closed by the surface being marked, a build up of pressure in the aperture could cause the device to be momentarily dislodged and misaligned. Accordingly, even on the continuous conical outer surface of FIGS. 1 to 6, there could be a small pressure relief channel provided.

Figure 9:
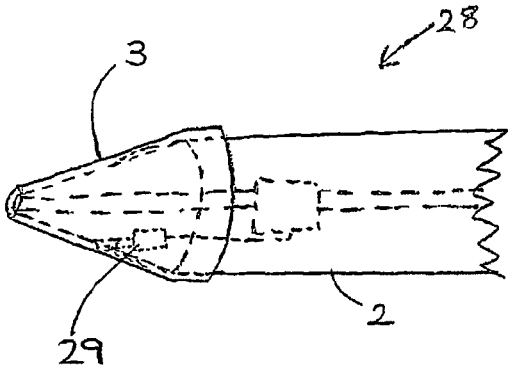
FIG. 9 is a diagrammatic side view of part of a device in accordance with another embodiment of the invention and FIGS. 10A and 10B are diagrammatic side views of part of a device in accordance with another embodiment of the invention.

Referring now to FIG. 9 of the accompanying drawings, a device 28 in accordance with another embodiment of the invention is shown. The guide arrangement 3 is moveably mounted to the body 2, between a first position and a second position. The guide arrangement 3 of the device 28 covers an activation arrangement in the form of an activation switch 29 which is triggered when the guide arrangement 3 is moved from the first position to the second position. A resilient biasing element biases the guide arrangement 3 towards the first position in which the guide arrangement 3 is spaced from the outer surface of the body 2 as shown in FIG. 9. The end of the body 2 of the device 28, adjacent the guide arrangement is shaped so as to correspond to the guide arrangement. Accordingly, the guide arrangement is effectively a thin-walled 'cover,' movable with respect to the body 2.

Figure 10A:
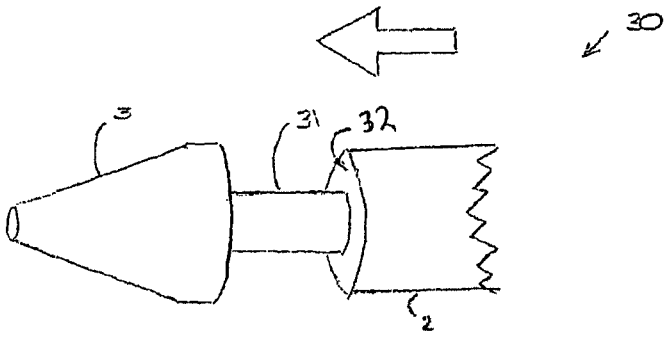

Referring now to FIG. 10A of the accompanying drawings, a device 30 in accordance with another embodiment of the invention is similar to device 28 of FIG. 9 in that the guide arrangement is movable relative to the body. The guide arrangement 3 of the device 30, as with the previous embodiment, covers an activation arrangement in the form of an activation switch 29 (not shown) which is triggered when the guide arrangement 3 is moved from a first position to a second position relative to the body. The guide arrangement 3 is connected to the body 2 by a neck 31, which provides the delivery arrangement, and which in this embodiment is substantially cylindrical as shown in FIG. 10A. The neck 31 is movable with respect to either the guide arrangement or the body. For example, the neck 31 may be connected to or form part of the guide arrangement, and slidably received through an aperture in the end of the body to provide a plunger, which is operable to eject the marking substance along the output path via the delivery arrangement. A resilient biasing element biases the guide arrangement 3 towards a first position in which the guide arrangement 3 is spaced from the outer surface of the body 2 as shown in FIG. 10A. In this embodiment, the body 2 is substantially cylindrical with a substantially flat end 32.

Figure 10B:
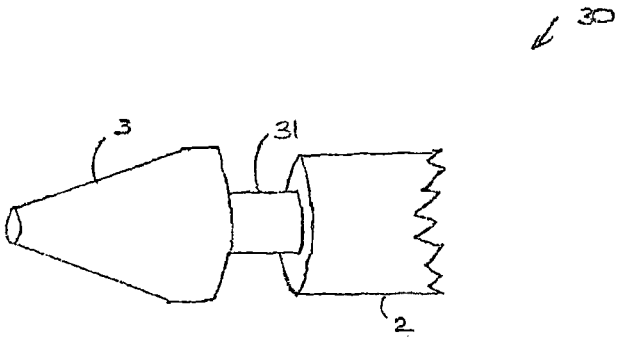

In use, a user inserts at least the second end of the guide arrangement into an aperture so that the outer surface of the guide arrangement 3 contacts the aperture. The user then pushes the body 2 towards the aperture so that the guide arrangement 3 is moved from the first position to a second position to trigger the activation arrangement. FIG. 10A shows the guide arrangement in the first position; and FIG. 10B shows the guide arrangement in the second position.

In an alternative embodiment, the user may twist the body 2 radially, so that the guide arrangement 3 is moved from the first position to a second position, which is radially distanced from the first position, to trigger the activation arrangement. FIG. 10B shows the device 30 when the activation arrangement is triggered. A user can thus trigger the activation arrangement easily so that a quantity of marking substance is delivered from the end of the device without the user having to press a manually operable switch.

In other embodiments, the body of the device incorporates a recess to receive a cartridge containing a quantity of marking substance. Cartridges containing a quantity of marking substance can thus be supplied separately to the device and installed in the recess in the device to effectively refill the device. The cartridges may be pressurized with a gas propellant and may incorporate ink, dry ink or powder.

In other embodiments, two separate chambers are provided; one for the marking substance and another which is configured to contain compressed gas. In these embodiments, one or both of the chambers may be refillable respectively with a quantity of marking substance or a quantity of compressed gas.

In further embodiments, the delivery arrangement comprises a piston and cylinder arrangement in which the piston may be held against a bias in an initial position. Upon triggering the activation arrangement, the piston is released and is moved by the force of the bias to push gas out from within the cylinder to eject a quantity of the marking substance out from the second end of the marking device. The device is then configured to be re-set manually by a user pulling the piston, or an element connected to the piston, to the position where the piston is held against the bias.

In a further embodiment, the marking substance is held within a moveable marking element which is, for instance, a felt tip pen or a pen incorporating a nib. In these embodiments, the marking element is moveable along the output path so that the end of the marking element protrudes from the second end of the guide arrangement to mark the surface. In this way, the marking substance is still moveable along the output path and out from the second end to mark the surface. The marking element might, for instance, be spring-loaded and configured to protrude out from the end of the guide arrangement in response to triggering of the activation arrangement.

In another embodiment, not shown, at least a part of the body of the marking device may be flexible and provides the activation arrangement. The user squeezing the flexible body causes an increase in the internal pressure, which causes some of the marking substance to be expelled through the delivery arrangement.

Preferably, the delivery arrangement is configured to vaporize the marking substance.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realizing the invention in diverse forms thereof.

What is claimed is:

1. A device for marking a surface through an aperture in an element positioned adjacent to the surface, the device comprising:

a body containing a marking substance selected from the group consisting of ink and powder;

a guide arrangement having a first end and a second end, at least a portion of an outer surface of the guide arrangement tapering from the first end to the second end which is narrower than the first end, wherein an output path is provided through the second end at substantially the center of the guide arrangement, wherein the guide arrangement comprises a plurality of elongate guide elements and the portion of the outer surface is defined by a portion of the outer surfaces of the elongate guide elements;

an activation arrangement;

a delivery arrangement which is configured, in response to triggering of the activation arrangement, to deliver a quantity of the marking substance from the body, along the output path and out of the second end, wherein the guide arrangement is moveable relative to the body and movement of the guide arrangement, relative to the body, from a first position to a second position, triggers the activation arrangement;

and wherein the activation arrangement is operable to be triggered by engaging the guide arrangement with the aperture and holding the body and pushing the body towards the aperture so that the body moves relative to the guide arrangement.

2. A device according to claim 1, wherein the activation arrangement is in the form of an activation switch which is covered by the guide arrangement.

3. A device according to claim 1, wherein the delivery arrangement is between the guide arrangement and the body.

4. A device according to claim 1, wherein the delivery arrangement is moveably mounted with respect to the body and configured such that, in response to triggering of the activation arrangement, the delivery arrangement extends from the body, with respect to the guide arrangement, to deliver a quantity of the marking substance from the body.

5. A device according to claim 4, wherein the delivery arrangement is biased away from the body.

6. A device according to claim 1, wherein the body is configured to store the marking substance in a chamber which incorporates an inlet through which a quantity of the marking substance can be introduced to at least partly fill the chamber.

7. A device according to claim 1, wherein the body incorporates a recess to receive a cartridge containing a quantity of the marking substance.

8. A device according to claim 1, wherein the delivery arrangement comprises a valve which is configured to be opened in response to triggering of the activation arrangement.

9. A device according to claim 8, wherein the valve is configured to open continuously whilst the activation arrangement is triggered.

10. A device according to claim 8, wherein the valve is a shuttle valve which is configured to deliver a predetermined quantity of the marking substance along the output path in response to triggering of the activation arrangement.

11. A device according to claim 8, wherein the device incorporates a source of compressed gas, the valve of the delivery arrangement being configured to release a quantity of the compressed gas to drive a quantity of the marking substance along the output path.

12. A device according to claim 1, wherein the portion of the outer surface of the guide arrangement is frusta-conical in shape.

13. A device according to claim 1, wherein the portion of the outer surface of the guide arrangement is curved.

14. A device according to claim 1, wherein the angle of each of the guide elements relative to the longitudinal axis of the guide arrangement is adjustable.

15. A method of marking a surface comprising:

providing a marking device which comprising:

a body containing a marking substance selected from the group consisting of ink and powder;

a guide arrangement having a first end and a second end, at least a portion of an outer surface of the guide arrangement tapering from the first end to the second end which is narrower than the first end, wherein an output path is provided through the second end at substantially the center of the guide arrangement, wherein the guide arrangement comprises a plurality of elongate guide elements and the portion of the outer surface is defined by a portion of the outer surfaces of the elongate guide elements;

an activation arrangement;

a delivery arrangement which is configured, in response to triggering of the activation arrangement, to deliver a quantity of the marking substance from the body, along the output path and out of the second end, wherein the guide arrangement is moveable relative to the body and movement of the guide arrangement, relative to the body, from a first position to a second position, triggers the activation arrangement;

and wherein the activation arrangement is operable to be triggered by engaging the guide arrangement with the aperture, and holding the body and pushing the body towards the aperture so that the body moves relative to the guide arrangement;

inserting at least the second end of the guide arrangement into an aperture in an element positioned adjacent a surface until a portion of the outer surface of the guide arrangement contacts the aperture, and holding the body, and pushing the body towards the aperture, so that the body moves relative to the guide arrangement to trigger the activation arrangement, such that the delivery arrangement delivers a quantity of the marking substance through the second end and onto the surface to mark the surface at a position which is substantially aligned with the center of the aperture.

16. A device for marking a surface through an aperture in an element positioned adjacent to the surface, the device comprising:

a body configured to store a marking substance;

a guide arrangement having a first end and a second end, at least a portion of an outer surface of the guide arrangement tapering from the first end to the second end which is narrower than the first end, wherein an output path is provided through the second end at substantially the center of the guide arrangement, wherein the guide arrangement comprises a plurality of elongate guide elements and the portion of the outer surface is defined by a portion of the outer surfaces of the elongate guide elements;

an activation arrangement; and a delivery arrangement which is configured, in response to triggering of the activation arrangement, to deliver a quantity of the marking substance from the body, along the output path and out of the second end, wherein the delivery arrangement comprises a valve which is configured to be opened in response to triggering of the activation arrangement;

wherein the device incorporates a source of compressed gas, the valve of the delivery arrangement being configured to release a quantity of the compressed gas to drive a quantity of the marking substance along the output path;

wherein the guide arrangement is moveable relative to the body and movement of the guide arrangement, relative to the body, from a first position to a second position, triggers the activation arrangement; and, wherein the activation arrangement is operable to be triggered by engaging the guide arrangement with the aperture and holding the body and pushing the body towards the aperture so that the body moves relative to the guide arrangement.

17. The device of claim 16, wherein the plurality of guide elements comprises at least three guide elements converging toward each other at the second end of the guide arrangement.

* * * * *